US007085511B2

(12) United States Patent
Park

(10) Patent No.: US 7,085,511 B2
(45) Date of Patent: Aug. 1, 2006

(54) OXIDATION CATALYST DEVICE AND WET-TYPE ELECTRO-PHOTOGRAPHIC IMAGEFORMING APPARATUS HAVING THE SAME

(75) Inventor: Geun-yong Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 176 days.

(21) Appl. No.: 10/895,890

(22) Filed: Jul. 22, 2004

(65) Prior Publication Data

US 2005/0129424 A1 Jun. 16, 2005

(30) Foreign Application Priority Data

Dec. 10, 2003 (KR) ..... 10-2003-0089273

(51) Int. Cl.
*G03G 21/00* (2006.01)

(52) U.S. Cl. ..... 399/93

(58) Field of Classification Search ..... 399/91–93
See application file for complete search history.

(56) References Cited

FOREIGN PATENT DOCUMENTS

| | | | |
|---|---|---|---|
| JP | 56162773 A | * | 12/1981 |
| JP | S57104968 | | 6/1982 |
| JP | S57-142655 | | 9/1982 |
| JP | 05023536 | * | 2/1993 |
| KR | 92-0003767 | | 6/1992 |
| KR | 2000-18735 | | 4/2000 |
| KR | 2000-56903 | | 9/2000 |
| KR | 2003-0014008 | | 2/2003 |

* cited by examiner

*Primary Examiner*—Arthur T. Grimley
*Assistant Examiner*—Ryan Gleitz
(74) *Attorney, Agent, or Firm*—Roylance, Abrams, Berdo & Goodman, L.L.P.

(57) ABSTRACT

An oxidation catalyst device is provided with a duct, a fan, a heater, an oxidation catalyst carrying element, and a heat-radiating duct. The duct is connected to a fixation device of the wet-type electrophotographic image forming apparatus. The fan, the heater and the oxidation catalyst carrying element are provided in the duct. The heat-radiating duct is installed to surround the duct and an airflow passage is formed between the outer wall of the duct and the inner wall of the heat-radiating duct.

14 Claims, 7 Drawing Sheets

OXIDATION CATALYST DEVICE AND WET-TYPE ELECTRO-PHOTOGRAPHIC IMAGEFORMING APPARATUS HAVING THE SAME

CROSS-REFERENCE TO RELATED APPLICATIONS

This application claims benefit under 35 U.S.C. §119(e) of Korean Application No. 2003-89273 filed Dec. 10, 2003, in the Korean Intellectual Property Office, the entire contents of which are incorporated herein by reference.

BACKGROUND OF THE INVENTION

1. Field of the Invention

The present invention relates to a wet-type electrophotographic image forming apparatus. More particularly, the present invention relates to an oxidation catalyst device for making oxidation resolution of carrier vapors generated in a fixation device and a wet-type electrophotographic image forming apparatus having the oxidation catalyst device.

2. Description of the Related Art

In general, a wet-type electrophotographic image forming apparatus is a printing apparatus, in which a laser beam is scanned onto a photosensitive medium thereby forming an electrostatic latent image. A developer is then deposited on the electrostatic latent image, thereby forming a visible image, and the visible image is transferred to paper. As a result, a desired image can be printed out. The wet-type electrophotographic image forming apparatus is particularly useful for color printing, because it can produce a more distinct image as compared to a dry-type electrophotographic image forming apparatus which uses powder toner.

FIG. 1 is a schematic view of a conventional wet-type electrophotographic image forming apparatus. The conventional wet-type electrophotographic image forming apparatus 100 comprises an image forming apparatus body 110, a plurality of photosensitive drums 121, 122, 123 and 124, a plurality of charging devices 131, 132, 133 and 134, a plurality of exposure devices 141, 142, 143 and 144, a plurality of developing devices 151, 152, 153 and 154, a transfer belt 160, a plurality of first transfer rollers 171, 172, 173 and 174, a second transfer roller 180, and a fixation device 190.

The plurality of developing devices 151, 152, 153, 154 store developers of different colors, respectively, and each of the developing devices supplies a color developer to corresponding one of the plurality photosensitive drums 121, 122, 123 and 124. The developers typically consist of toner-dispersed ink and liquid carrier such as norpar. The norpar is a hydrocarbon-based solvent, which is a mixture of $C_{10}H_{22}$, $C_{11}H_{24}$, $C_{12}H_{26}$, and $C_{13}H_{28}$. The developers are deposited on the respective photosensitive drums 121, 122, 123 and 124, thereby forming visible images. The visible images formed on the respective photosensitive drums 121, 122, 123 and 124 are moved onto the transfer belt 160, and transferred onto a paper P by the transfer roller 180. The paper P that receives the transferred developers is moved into the fixation device 190. When the paper P passes through the fixation device 190, the ink of the developers is fixed onto the paper. The liquid carrier of the developers is vaporized in the form of a combustible hydrocarbon gas such as $CH_4$ by a high temperature, and then discharged to the outside.

The combustible hydrocarbon gas is classified as a volatile organic compound (VOC), and can contaminate the local environment and emit an offensive odor when discharged as described. Accordingly, various methods for removing the combustible hydrocarbon gas have been developed in recent years.

Methods for removing the combustible hydrocarbon gases presently known in the art include a filtration method for physically removing gaseous components that uses a carbon filter such as active carbon. Other methods include a direct combustion method for combusting gaseous components at an ignition point (600° C.–800° C.), and a catalytic oxidation method for combusting gaseous components at a relatively lower temperature (150° C.–400° C.) that uses a catalyst by which the components are subjected to oxidation resolution and turned into water and carbon dioxide.

In the filtration method, however, the carbon filter does not have the capability of resolving the carrier vapors entrained therein. A carbon filter saturated with carrier vapors should be exchanged frequently with a new one when the carrier vapors are entrained over a predetermined amount in the carbon filter. The direct combustion method has the problem of potentially being unsafe.

Due to these problems, the catalytic oxidation method has been the preferred method in recent years. In addition, research has been conducted for realizing an oxidation catalyst device that has the benefits of good efficiency in oxidation resolution of carrier vapors, a high degree of stability in use and being safer than other methods.

SUMMARY OF THE INVENTION

An object of the present invention is to solve at least the above problems and/or disadvantages and to provide at least the advantages described below. Accordingly, an object of the present invention is to provide an oxidation catalyst device having improved efficiency and stability in use of the device, and a wet-type electrophotographic image forming apparatus equipped with the same.

In order to achieve the above-described aspects of the present invention, there is provided an oxidation catalyst device comprising a duct, a fan, a heater, an oxidation catalyst carrying element, and a heat-radiating duct. The duct is connected to a fixation device of the wet-type electrophotographic image forming apparatus. The fan, the heater and the oxidation catalyst carrying element are provided in the duct. The heat-radiating duct is installed to surround the duct, and an airflow passage is formed between the outer wall of the duct and the inner wall of the heat-radiating duct.

In the oxidation catalyst device according to one embodiment of the present invention constructed as the above, the outer wall of the heat-radiating duct is provided with heat-radiating members such as heat-radiating ribs and heat-radiating fins to increase the heat-radiating area of the heat-radiating duct.

In addition, a heat-radiating fan may be provided in a side of the heat-radiating duct in order to allow the air in the airflow passage to flow. In one embodiment of the present invention, the heat-radiating fan is provided within an opening formed in a side of the heat-radiating duct.

A heat insulation member is interposed between the oxidation catalyst carrying element and the duct.

A wet-type electrophotographic image forming apparatus fabricated according to an embodiment of the present invention comprises a photosensitive medium, an exposure device, a developing device, a fixation device and an oxidation catalyst device. The oxidation catalyst device comprises a duct, a fan, a heater, and a heat-radiating duct. The fan, heater and oxidation catalyst carrying element are installed within the duct, and an airflow passage is formed between the duct and the heat-radiating duct.

BRIEF DESCRIPTION OF THE DRAWINGS

The above object and other features of the present invention will become more apparent by describing in detail exemplary embodiments thereof with reference to the attached drawing figures, wherein.

In the drawing figures, it will be understood that like reference numerals refer to like features and structures.

DETAILED DESCRIPTION OF THE EXEMPLARY EMBODIMENTS

Hereinbelow, an oxidation catalyst device according to an embodiment of the present invention and a wet-type electrophotographic image forming apparatus equipped with the same will be described in detail with reference to the accompanying drawings.

Figure 1:
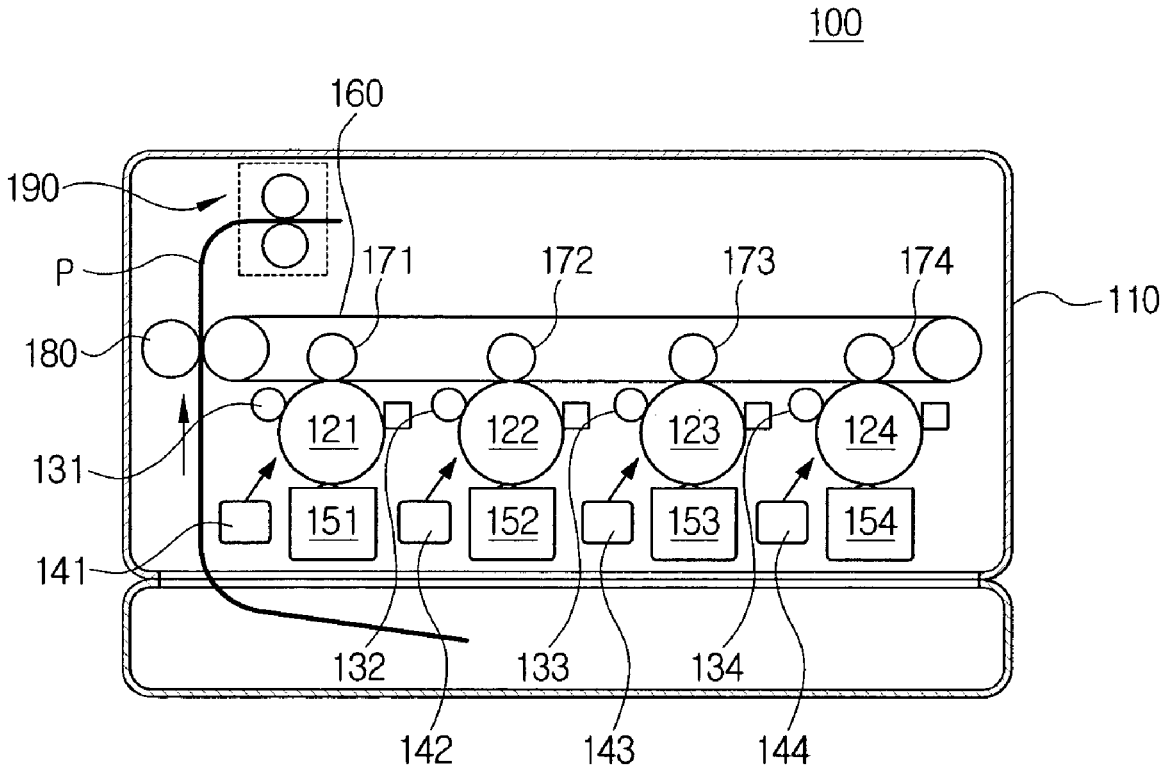
FIG. 1 (PRIOR ART)
FIG. 1 is a view illustrating a conventional wet-type electrophotographic image forming apparatus.
Figure 2:
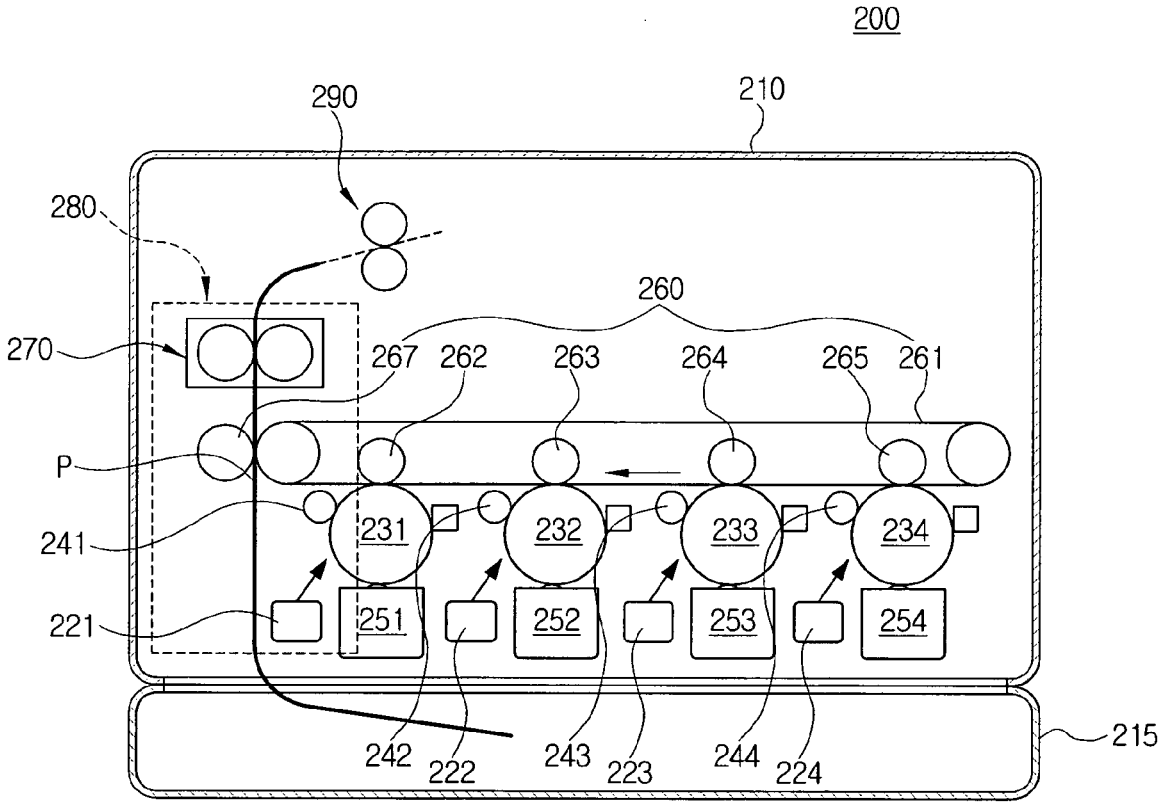
FIG. 2 is a view illustrating the construction of a wet-type electrophotographic image forming apparatus according to an embodiment of the present invention.

As shown in FIG. 2, the wet-type electrophotographic image forming apparatus 200 comprises an image forming apparatus body 210, a plurality of exposure devices 221, 222, 223 and 224, a plurality of photosensitive drums 231, 232, 233 and 234, a plurality of charging devices 241, 242, 243 and 244, a plurality of developing devices 251, 252, 253 and 254, a transfer device 260, a fixation device 270 and an oxidation catalyst device 280.

The exposure devices 221, 222, 223 and 224 generate and scan a laser beam onto the surfaces of the respective photosensitive drums charged to a predetermined potential by the charging devices 241, 242, 243 and 244, respectively. The surfaces of the respective photosensitive drums 231, 232, 233 and 234 are scanned with a laser beam and are formed with electrostatic latent images due to the potential difference between scanned portions and un-scanned portions of the drum surface.

The charging devices 241, 242, 243 and 244 electrify the surfaces of the respective photosensitive drums to predetermined potentials, so that the surfaces are provided with conditions for forming electrostatic latent images, respectively.

The developing devices 251, 252, 253 and 254 supply developers to the photosensitive drums 231, 232, 233 and 234. The developing devices 251, 252, 253 and 254 store developers of different colors such as yellow, magenta, cyan and black, respectively, and deposit the developers on the latent images formed on the surfaces of the respective photosensitive drums 231, 232, 233 and 234. The developers deposited on the electrostatic latent images form visible images on the surfaces of the photosensitive drums 231, 232, 233 and 234. The developers are formed from a toner-contained ink and liquid carrier such as norpar. The norpar is a hydrocarbon-based solvent that is a mixture of $C_{10}H_{22}$, $C_{11}H_{24}$, $C_{12}H_{26}$ and $C_{13}H_{28}$. The norpar is vaporized as a combustible hydrocarbon gas such as methane ($CH_4$) when it is heated.

The transfer device 260 transfers the visible images formed on the respective photosensitive drums 231, 232, 233 and 234 onto a paper P and comprises first transfer rollers 262, 263, 264, 265 and a second transfer roller 267. As shown in FIG. 2, the transfer belt 261 receives the visible images while being contacted with the surfaces of the photosensitive drums 231, 232, 233 and 234. The plurality of the first transfer rollers 262, 263, 264 and 265 are installed to correspond to the photosensitive drums 231, 232, 233 and 234, respectively, and transfer the visible images formed on the surfaces of the respective photosensitive drums 231, 232, 233 and 234 onto the transfer belt 261. The developers of different colors such as yellow, magenta, cyan and black are overlapped with each other on the transfer belt 261, thereby forming a color image. The second transfer roller 267 transfers the color image formed on the transfer belt 261 onto a paper P.

Figure 3:
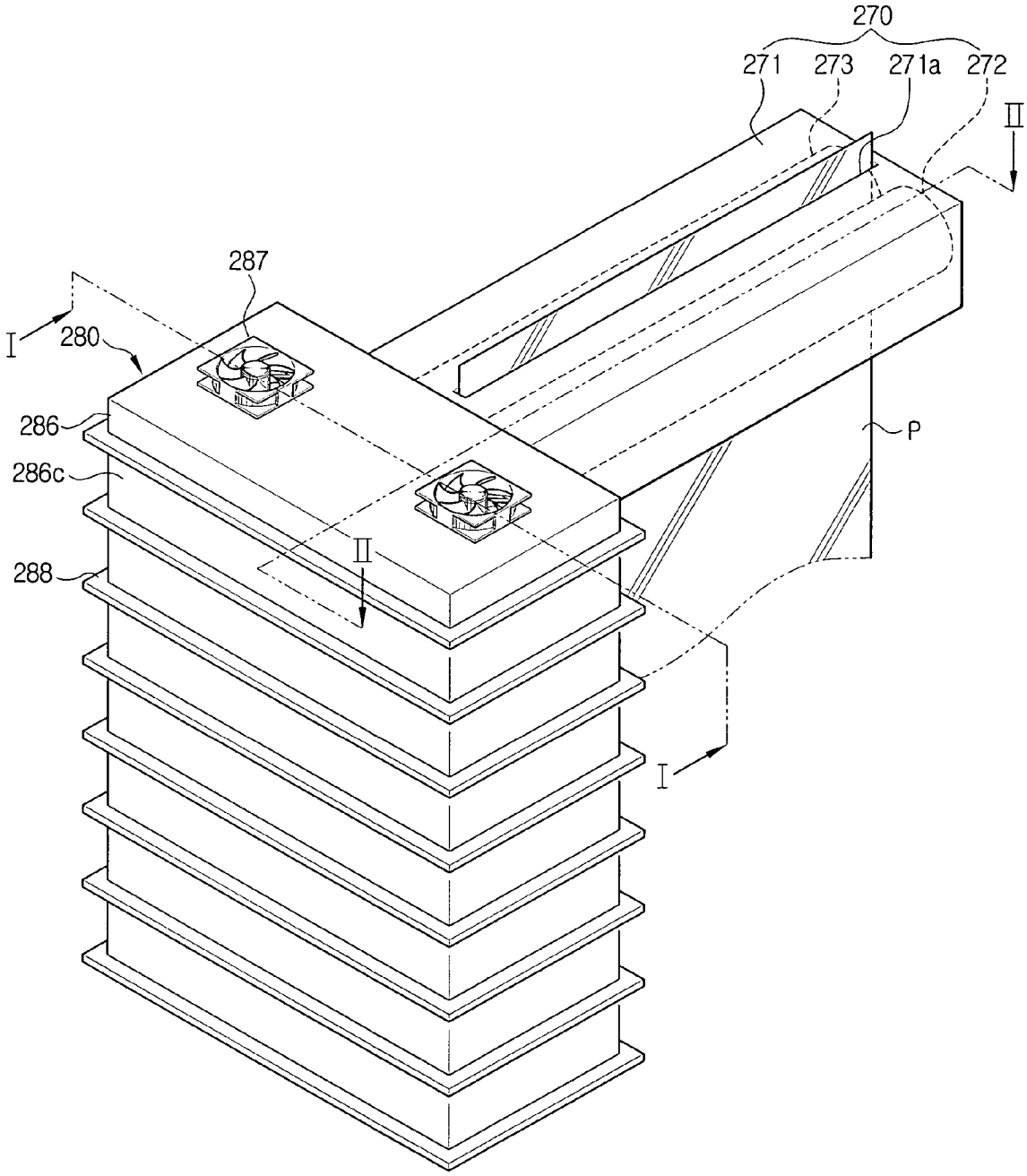
FIG. 3 is a perspective view illustrating the construction of a principal part of the wet-type electrophotographic image forming apparatus according to an embodiment of the present invention.

The fixation device 270 applies heat and pressure to the paper P, to which the color image has been transferred, so that the carrier of developer components is vaporized and the ink is fixed on the paper P. In the fixation device 270 as shown in FIG. 3, a heating roller 272 and a compression roller 273 are in close contact within a casing 271 formed with a paper passage slot 271*a*. The heating roller 272 is equipped with a heating element such as a heating lamp or an electric heating wire.

Figure 4:
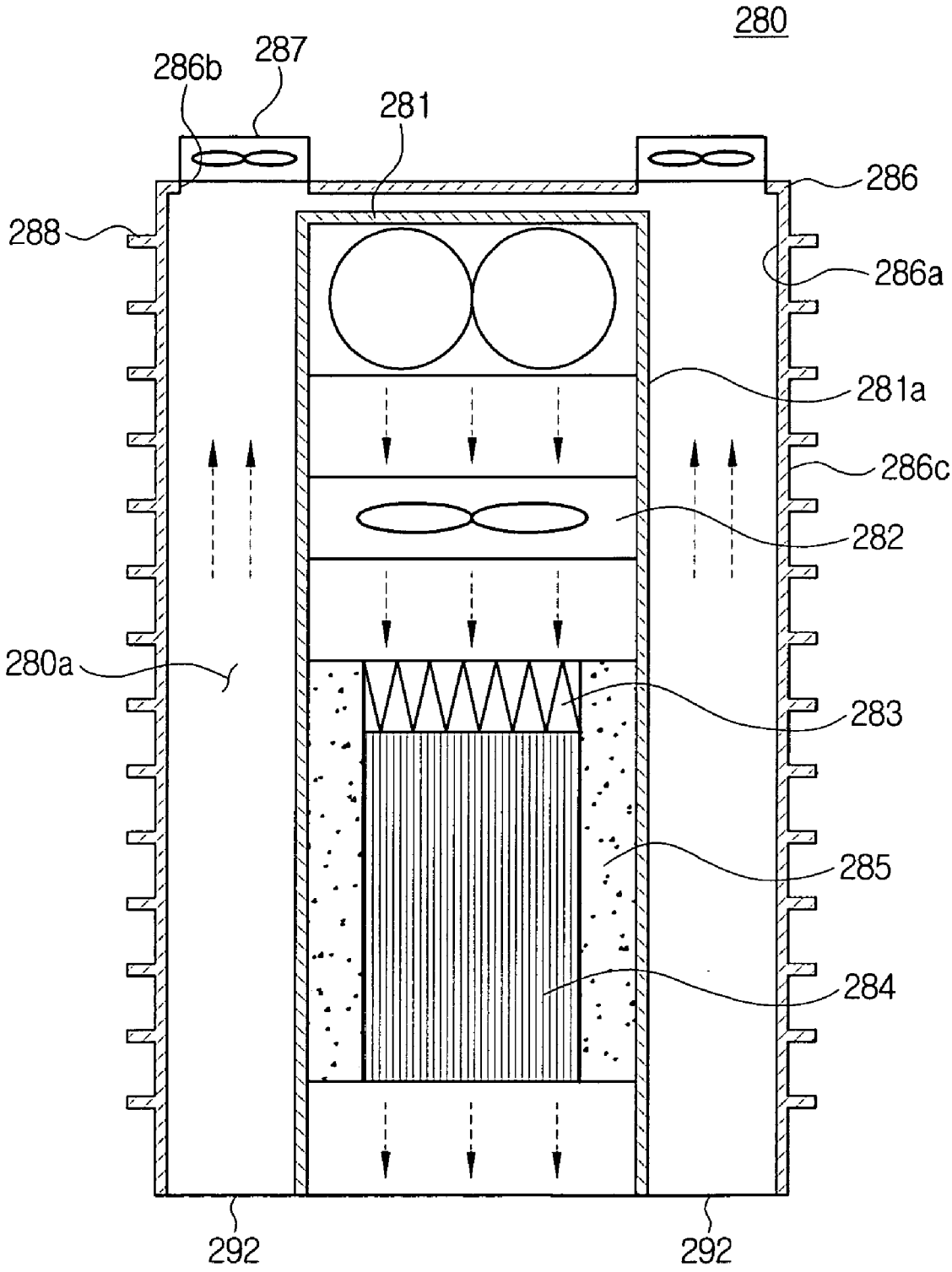
FIG. 4 is a longitudinal sectional view of an oxidation catalyst device according to an embodiment of the present invention taken in the direction indicated by I—I of FIG. 3.
Figure 5:
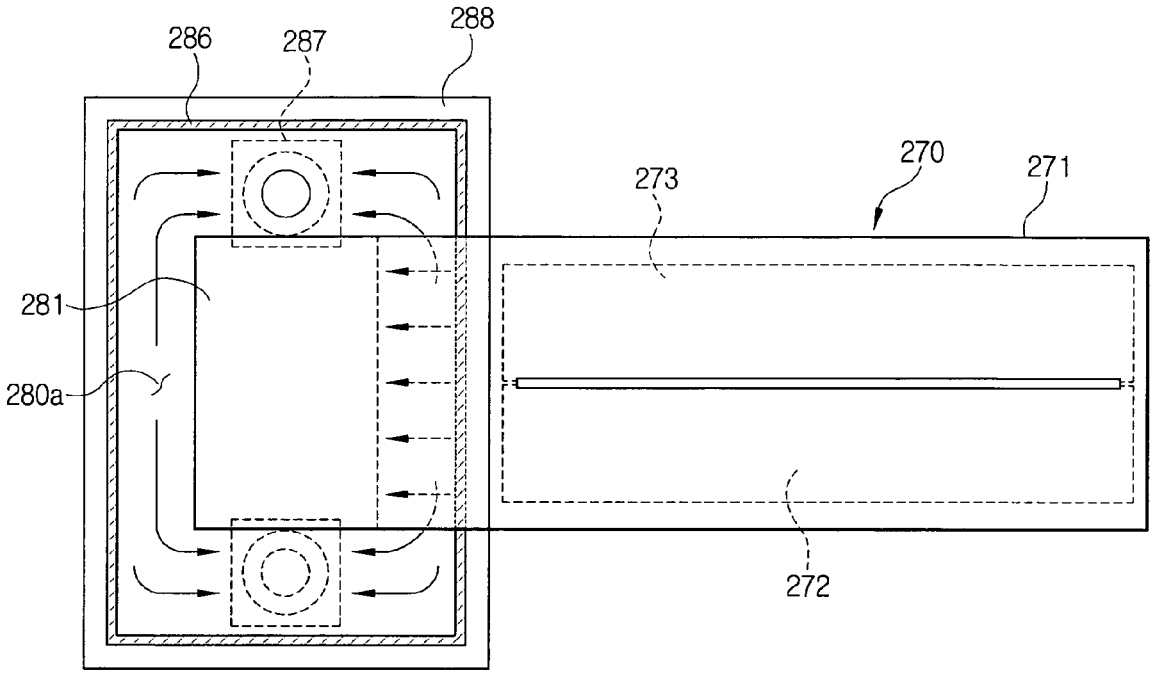
FIG. 5 is a cross-section view of the oxidation catalyst device according to an embodiment of the present invention taken in the direction indicated by II—II of FIG. 3.

The oxidation catalyst device 280 functions to purify carrier vapors generated in the fixation device 270, in which the oxidation catalyst device 280 is connected to the fixation device 270. As shown in FIGS. 3 to 5, the oxidation catalyst device 280 comprises a duct 281, a fan 282, a heater 283, an oxidation catalyst carrying element 284, a heat insulation member 285 and a heat-radiating duct 286. The duct 281 is connected to a side of the casing 271 of the fixation device 270 at its one end, as shown in FIG. 5, and guides carrier vapors generated within the casing 271 to the outside of the image forming apparatus body 210. The fan 282 is installed within the duct 281, so that the fan 282 forcibly discharges carrier vapors within the casing 271 to the outside of the casing 271. The heater 283 increases the temperature of carrier vapors up to an activation temperature, for example, to approximately 200° C. The oxidation catalyst carrying element 284 carries oxidation catalytic material such as platinum (Pt) or palladium (Pd) for facilitating oxidation resolution reaction of carrier vapors. The oxidation catalyst carrying element 284 is located below the heater 283. The oxidation catalyst carrying element 284 is heated up to about 300° C. as the heat generated from the oxidation resolution reaction of carrier vapors is added to the heat transferred from the carrier vapors of about 200° C. The heat insulation member 285 is interposed between the oxidation catalyst carrying element 284 and the duct 281, so that the oxidation catalyst carrying element 284 can maintain high temperature without being readily cooled.

In addition, the heat-radiating duct 286 surrounds the outside of the duct 281 so as to efficiently prevent high temperatures from being emitted to the outside of the duct 281 and to more efficiently discharge the heat to the outside of the duct 281. This prevents other components within the image forming apparatus body 210 from being exposed to high temperatures. As shown in FIG. 4, an airflow passage 280*a* is formed between the outer wall 281*a* of the duct 281 and the inner wall 286*a* of the heat-radiating duct 286. The airflow passage 286*a* serves to prevent the heat emitted from the duct 281 from being rapidly transferred to the heat-radiating duct 286. The heat-radiating duct 286 is opened at its lower part so that the air within the airflow passage 280*a* can be discharged. The heat-radiating duct 286 is preferably formed of a material having low heat conductivity such as plastic. In addition, it is preferable that the outer wall 281*a* of the duct 281 and the inner wall 286*a* of the heat-radiating duct 286 are formed of smooth surfaces so that the air can smoothly flow.

Figure 6:
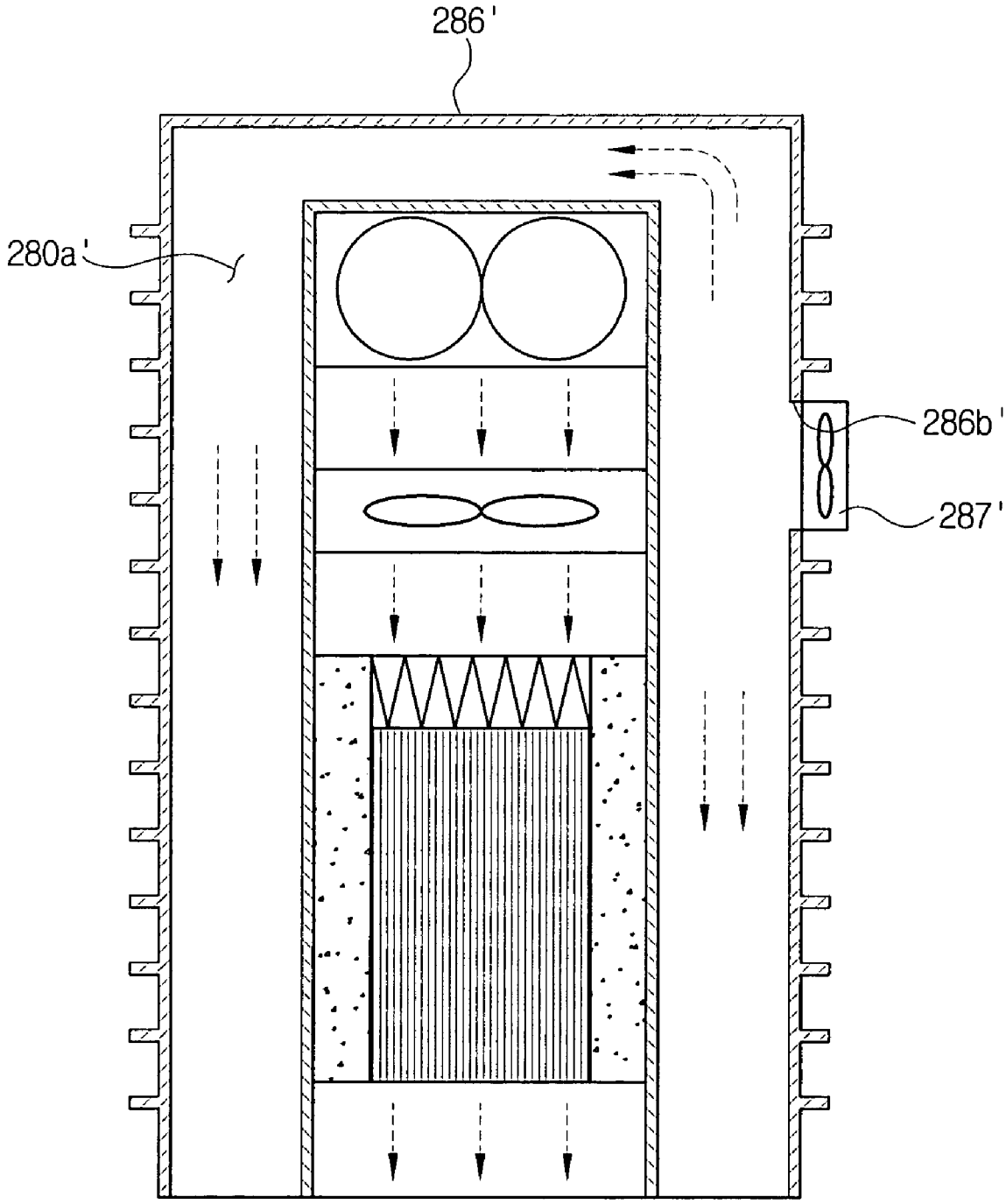
FIGS. 6 and 7 are views illustrating an oxidation catalyst oxidation according to another embodiment of the present invention.

The top of the heat-radiating duct 286 has openings 286*b*, each provided with a heat discharge fan 287. The heat discharge fans 287 facilitate airflow within the airflow passage, so that the heat generated from the heater 283 and the oxidation catalyst carrying element 284 is evenly dispersed without being concentrated to a local area. As shown in FIGS. 4 and 5, if the heat discharge fans 287 are driven, air is admitted through the opened bottom 292 of the heat-radiating duct 286 and the admitted air passes through the airflow passage 280*a* and then flows out through the openings 286*b* (FIG. 4), occupied by the heat discharge fans 287. The positions for mounting such heat discharge fans 287 and the number of such heat discharge fans 287 can be variously selected. In a different embodiment of the present invention shown in FIG. 6, only one opening 286*b*' can be provided for connecting the airflow passage 280*a*' of the heat-radiating duct 286' and the outside of the heat-radiating duct 286,' and one heat discharge fan 287' can be provided within this opening 286*b.'*

Figure 7:
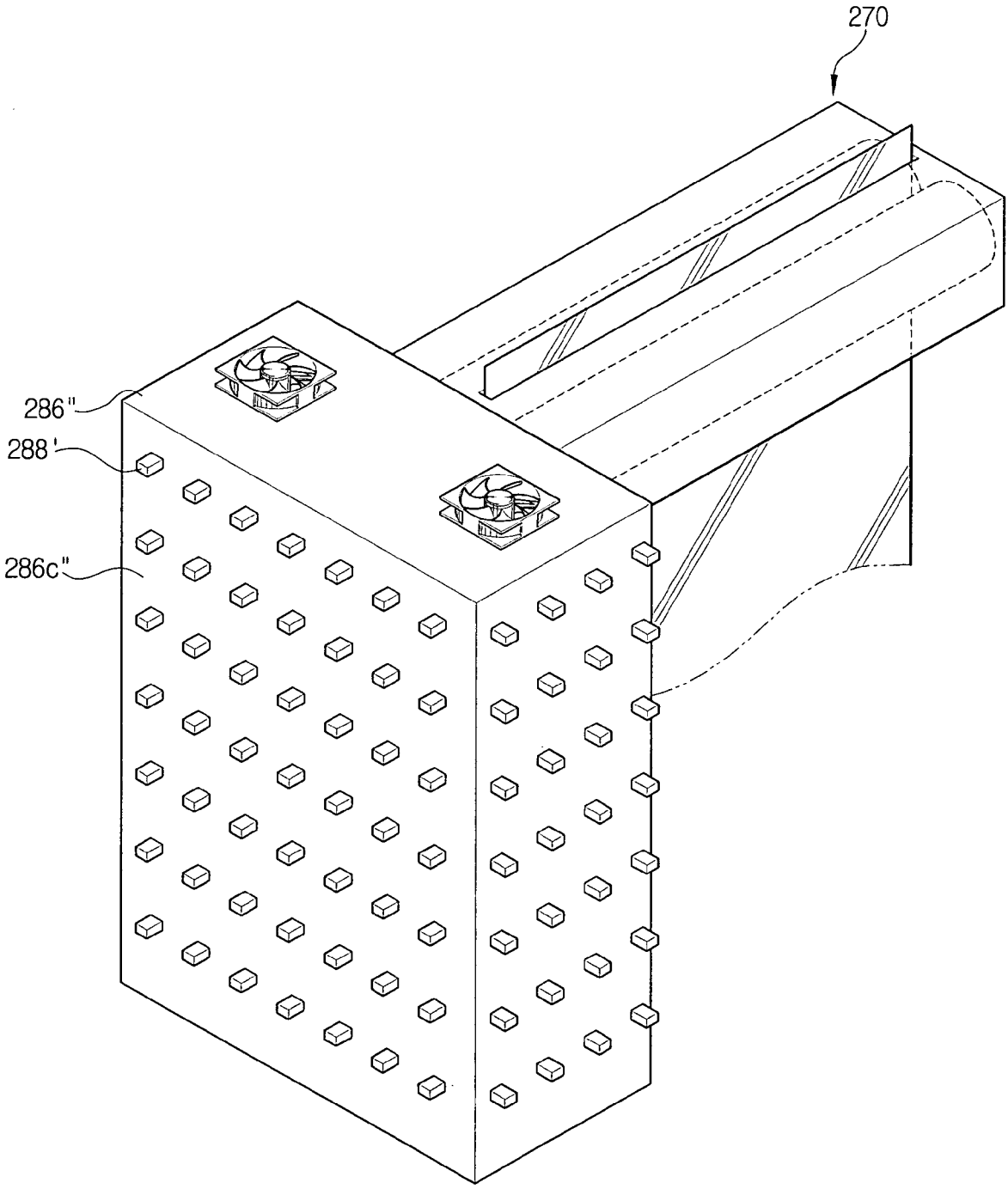

Referring back to FIGS. 3–5, a plurality of heat-radiating ribs 288 preferably provided on the outer wall of the heat-radiating duct 286, thereby increasing the area of the outer surface of the heat-radiating duct contacting with the surrounding air. As the heat-radiating area is increased in this manner by the heat-radiating ribs 288, the heat-radiating efficiency of the heat-radiating duct 286 can be improved. In an embodiment of the present invention, it is also possible to provide other heat-radiating members instead of the heat-radiating ribs 288. In a different embodiment of the present invention as shown in FIG. 7, it is possible to increase the heat-radiating area of the heat-radiating duct 286" by providing a plurality of heat-radiating fins 288' on the outer wall 286*c*" of the heat-radiating duct 286".

Hereinbelow, operation of an oxidation catalyst device 280 according to an embodiment of the present invention and a wet-type electrophotographic image forming apparatus will be described.

If a printing command is transmitted to the image forming apparatus, as shown in FIG. 2, a laser beam is illuminated from the exposure devices 221, 222, 223 and 224 to the surfaces of the respective photosensitive drums 231, 232, 233 and 234 charged by the charging rollers 241, 242, 243 and 244 to a predetermined potential. The surfaces of the developing devices 251, 252, 253 and 254 illuminated with the laser beam are formed with electrostatic latent images while the charged potential is being changed. Then, the developing devices 251, 252, 253 and 254 deposit developers of yellow, magenta, cyan and black, for example, onto the electrostatic latent images formed on the photosensitive drums 231, 232, 233 and 234, respectively, thereby forming visible images. The visible images of the four colors formed in this manner are sequentially transferred to the transfer belt 261 by the first transfer rollers 262, 263, 264 and 265, and a color image is formed on the transfer belt 261 as the developers of four colors is overlapped. While the image forming processes are being performed, a paper-feeding device 215 moves the paper P to the transfer belt 261. When the paper P moves into the space between the transfer belt 261 and the second transfer roller 267, the color image formed on the transfer belt 261 is transferred to the paper P by the second transfer belt 267, and the paper P proceeds toward the fixation device 270.

As shown in FIG. 3, the paper P that has arrived at the fixation device 270 passes the space between the heating roller 272 and the compression roller 273, and is forced out of the fixation device 270 through the paper passage slot 271*a* formed in the casing 271. Then the paper P is discharged out of the image forming apparatus body 210 through the paper-discharging device 290 (FIG. 2). When the paper P passes the space between the heating roller 272 and the compression roller 273, the carrier of the developer components transferred onto the paper P is vaporized while the ink is fixed onto the paper by the heat generated from the heating roller 272.

The carrier vapors generated in the casing 271 is pumped out into the duct 281 by the fan 282 as shown in FIG. 4. The carrier vapors in the duct 281 are heated to an activation temperature of about 200° C. while passing through the heater 283 and then flowed toward the oxidation catalyst carrying element 284. The carrier vapors passing through the oxidation catalyst carrying element 284 in the duct are subjected to oxidation resolution, thereby being turned into water and carbon dioxide and then discharged out of the duct 281. While the carrier vapors are being subjected oxidation resolution, heat is generated due to the oxidation resolution reaction and the temperature of the oxidation catalyst carrying element 284 is increased to approximately 300° C. However, the heat generated due to the oxidation resolution reaction is gradually transferred to the duct 281 through the heat insulation member 285.

The heat transferred to the duct 281 is transferred to the heat-radiating duct 286 through the airflow passage 280*a*. Air flowing within the airflow passage 280*a* due to the heat-radiating fan 287 rapidly discharges the heat emitted out of the duct 281. In addition, the heat-radiating ribs 288 provided on the outer wall 286*c* of the heat-radiating duct 286 facilitates the heat exchange between the airflow passage 280*a* and the outside of the heat-radiating duct 286, thereby helping the discharge of the heat transferred to the airflow passage 280*a*. Consequently, the large amounts of heat generated within the duct 281 are efficiently radiated without being directly transferred to various components in the image forming apparatus body 210.

The heat insulation member 285 interposed between the oxidation catalyst carrying element 284 and the duct 281 retains the heat of the oxidation catalyst carrying element 284, so that the temperature of the oxidation catalyst carrying element 284 can be smoothly increased to the activation temperature of the carrier vapors. Through use of the heat insulation member 285, the oxidation resolution efficiency of the carrier vapors can be enhanced.

As can be appreciated from the above description of an embodiment of the present invention, since the airflow passage 280*a* is formed between the duct and the heat-radiating duct installed to surround the duct 281, heat generated within the duct 281 can be efficiently radiated. In addition, a heat-radiating duct 286 disperses and discharges the heat generated within the duct 281 with an increased heat-radiating area. Accordingly, the various components of the image forming apparatus are not damaged by high temperature, and a wet-type electrophotographic image forming apparatus can be improved in safety of use.

Furthermore, according to an embodiment of the present invention, since the temperature of the oxidation catalyst carrying element does not easily decrease, the oxidation catalyst apparatus in which the oxidation resolution reaction of carrier vapors can be facilitated and a wet-type electrophotographic image forming apparatus equipped with the same can be realized.

While various embodiments of the present invention have been shown and described to illustrate the principle of the present invention, the present invention is not limited to the embodiments described. It will be understood that various modifications and changes can be made by those skilled in the art without departing from the spirit and scope of the invention as defined by the appended claims. Therefore, it shall be considered that such modifications, changes and equivalents thereof are all included within the scope of the present invention.

What is claimed is:

1. An oxidation catalyst device for oxidation resolution of carrier vapors generated in a fixation device of a wet-type electrophotographic image forming device, comprising:

a duct connected to the fixation device to guide the carrier vapors generated in the fixation device to the outside of the fixation device;

a fan installed within the duct to forcibly discharge the carrier vapors generated within the fixation device;

a heater installed within the duct to heat the carrier vapors guided along the duct;

an oxidation catalyst carrying element installed within the duct to facilitate the oxidation resolution reaction of the carrier vapors guided along in the duct; and a heat-radiating duct installed to surround the duct, wherein an airflow passage is formed between the outer wall of the duct and the inner wall of the heat-radiating duct.

2. The device according to claim 1, wherein the heat-radiating duct is provided with at least one heat-radiating member to increase the heat-radiating area of the heat-radiating duct.

3. The device according to claim 2, wherein the at least one heat-radiating member is a heat-radiating rib installed on the outer wall of the heat-radiating duct.

4. The device according to claim 2, wherein the at least one heat-radiating member is a heat-radiating fin installed on the outer wall of the heat-radiating duct.

5. The device according to claim 1, wherein a heat-radiating fan is provided in a side of the heat-radiating duct to facilitate the flow of air within the airflow passage.

6. The device according to claim 5, wherein an opening is formed in a side of the heat-radiating duct and the heat-radiating fan is installed within the opening, so that the heat-radiating fan can admit air outside of the heat-radiating duct to flow into the airflow passage.

7. The device according to claim 1, wherein a heat insulation member is interposed between the oxidation catalyst member and the duct.

8. A wet-type electrophotographic image forming apparatus comprising:

a photosensitive medium;

an exposure device for scanning a laser beam onto the photosensitive medium;

a developing device for depositing a developer consisting of an ink and a carrier onto the photosensitive medium;

a transfer device for transferring the developer deposited on the photosensitive medium to a paper;

a fixation device for applying heat to a paper receiving a transferred developer; and an oxidation catalyst device for oxidation resolution of the carrier vapors generated in the fixation device, wherein the oxidation catalyst device comprises:

a duct connected to the fixation device in order to guide the carrier vapors generated in the fixation device to the outside of the fixation device;

a fan installed within the duct in order to forcibly discharge the carrier vapors generated within the fixation device;

a heater installed within the duct in order to heat the carrier vapors guided along the duct;

an oxidation catalyst carrying element installed within the duct in order to facilitate the oxidation resolution reaction of the carrier vapors guided along in the duct; and a heat-radiating duct installed to surround the duct, wherein a airflow passage is formed between the outer wall of the duct and the inner wall of the heat-radiating duct.

9. The apparatus according to claim 8, wherein the heat-radiating duct is provided with at least one heat-radiating member to increase the heat-radiating area of the heat-radiating duct.

10. The apparatus according to claim 9, wherein the at least one heat-radiating member is a heat-radiating rib installed on the outer wall of the heat-radiating duct.

11. The apparatus according to claim 9, wherein the at least one heat-radiating member is a heat-radiating fin installed on the outer wall of the heat-radiating duct.

12. The apparatus according to claim 8, wherein a heat-radiating fan is provided in a side of the heat-radiating duct to facilitate the flow of air within the airflow passage.

13. The apparatus according to claim 12, wherein an opening is formed in a side of the heat-radiating duct and the heat-radiating fan is installed within the opening, so that the heat-radiating fan can admit air outside of the heat-radiating duct to flow into the airflow passage.

14. The apparatus according to claim 8, wherein a heat insulation member is interposed between the oxidation catalyst member and the duct.

* * * * *